US005275188A

United States Patent [19]

Tsai

[11] Patent Number: 5,275,188

[45] Date of Patent: Jan. 4, 1994

[54] MODIFIED FOLDING TENT

[76] Inventor: Ming L. Tsai, 4th Fl., 8-3 Fuchin St., Taipei, Taiwan

[21] Appl. No.: 910,752

[22] Filed: Jul. 8, 1992

[30] Foreign Application Priority Data

Aug. 9, 1991 [CN] China ..... 91105446.4

[51] Int. Cl.[5] ..... E04H 15/18

[52] U.S. Cl. ..... 135/97; 135/110; 135/109; 52/109

[58] Field of Search ..... 135/110, 119, 115, 114, 135/99, 103, 106, 109, 107, 108, 112, 97; 52/109

[56] References Cited

U.S. PATENT DOCUMENTS

| | | | |
|---|---|---|---|
| 1,853,367 | 4/1932 | Mace | 135/110 |
| 3,161,990 | 12/1964 | Morris, Jr. | 135/99 X |
| 4,607,656 | 8/1986 | Carter | 135/110 |
| 4,641,676 | 2/1987 | Lynch | 135/110 |
| 4,779,635 | 10/1988 | Lynch | 135/97 |
| 4,884,589 | 12/1989 | Simpson | 135/119 X |
| 4,885,891 | 12/1989 | Lynch | 135/110 X |
| 4,947,884 | 8/1990 | Lynch | 135/97 |

FOREIGN PATENT DOCUMENTS

| | | | |
|---|---|---|---|
| 0053860 | 2/1967 | German Democratic Rep. | 135/99 |
| 0093983 | 4/1991 | Japan | 135/99 |
| 0074788 | 5/1954 | Netherlands | 135/99 |

*Primary Examiner*—Carl D. Friedman
*Assistant Examiner*—Lan M. Mai
*Attorney, Agent, or Firm*—Morton J. Rosenberg; David I. Klein

[57] ABSTRACT

A modified folding tent is provided. The tent comprises a plurality of main supporters and supporting structures, and a topmost supporter, to form a frame which is covered by an awning. Each main supporter has an inner supporter and a slide. Each supporting structure is provided with a pair of U-shaped covers to provide a sturdy connection. The awning and main supporters are coupled together by studs passing through holes in the awning and wing nuts tightened on the studs. The topmost supporter has a resilient inner supporter, to make the awning look smooth and good-looking. The modified structure ensures high strength of the tent and proper stability thereof, when it is opened.

1 Claim, 3 Drawing Sheets

MODIFIED FOLDING TENT

BACKGROUND OF THE INVENTION

1. Field of the Invention

The present invention relates to a folding tent. Particularly, this invention relates to a modified folding tent with a more stable structure, and a more smooth and good-looking appearance when the tent is in an unfolded position.

2. Prior Art

Folding tents are used in outdoor activities, such as camping, picnicking, outdoor cooking, for fairs or other outdoor relaxation activities. A folding tent is greatly popular with users because of its wonderful practicality. Folding tents are easily opened and propped up to cover a wide area with the awning. They can be folded quickly to a small size, to be stored and carried conveniently.

With traditional folding tents, their elementary parts have proved to have shortcomings in their structure. For example, the bond between the awning and the support assembly is not very strong, and the tent will be deformed by a burst of strong wind. Additionally, when the supporting structure of a regular folding tent is frequently opened and closed, the joining screws and the supporting structure is easily damaged, due to the repeated interlocking and telescopic movements.

Furthermore, the topmost supporter located at the highest position of the support assembly, of a traditional tent, is a fixed structure, which will result in wrinkling of the awning when the supporter is propped up. Moreover, the awning will be fatigued and deformed, and cannot maintain a smooth and aesthetic appearance, because of water absorption on rainy days.

In view of the above-mentioned numerous shortcomings of regular folding tents, the present invention provides an improved folding tent. The present invention is designed to include a locating device disposed within each main supporter, a resilient topmost supporter and U-shaped covers for the supporting structures, to promote the stability and strengthen the structure of the folding tent.

SUMMARY OF THE INVENTION

The tent according to the present invention comprises a telescopic folding support assembly and an awning spread thereon. The assembly comprises at least four main supporters, twelve supporting structures, which together appear to look like a window with a cross in it. The assembly further includes a topmost supporter located in the center of the supporting structure. Each main supporter is provided with a telescopic inner supporter, and the topmost supporter is provided with a resilient inner supporter. Each supporting structure consists of two interlocking bars, and U-shaped covers, with hinge screws being provided at the interlocking points. Each of the main supporters are provided with a protruding stud, and the awning is also provided with holes corresponding to the studs for the latter to pass through, the awning being secured thereto by wing nuts. Each main supporter is provided with a slide for joining the connecting supporting structures, and each slide has a positioning hole. Further, at the top of the main supporter, there is provided an elastic pin for engagement within the positioning hole when the slide moves to the top of said main supporter and the supporting structures are fully opened. The topmost supporter comprises a resilient supporting device, formed by a spring and an inner supporter. The topmost supporter is located in the center of the structure and is connected to the supporting structures in four directions by means of a slide. The spring of the resilient supporting device is fixed within the hollow of the topmost supporter by a screw which passes through the bottom thereof. The inner supporter is coupled to the top of the spring.

The main object of the present invention is to provide a folding tent, having a support assembly comprising a plurality of main supporters, each being provided with an inner supporter, as a locating device, to facilitate quick opening and fixing of the position of the tent, as well as facilitating the taking apart of the support assembly.

A secondary object of the present invention is to provide an improved folding tent, which includes U-shaped covers at the interlocking point of each supporting structure, so as to secure the strength against damage and prolong the life of use.

Another object of the present invention is to provide an improved folding tent, which uses wing nuts to secure the awning to the support assembly, so that the tent can be taken apart or assembled more conveniently and quickly.

A fourth object of the present invention is to provide an improved folding tent, where the topmost supporter is provided with a resilient inner supporter, propping up the awning to keep it smooth and aesthetic in appearance.

The present invention will now be described in detail, referring to the accompanying drawings, wherein:

DESCRIPTION OF THE PREFERRED EMBODIMENTS

Figure 1:
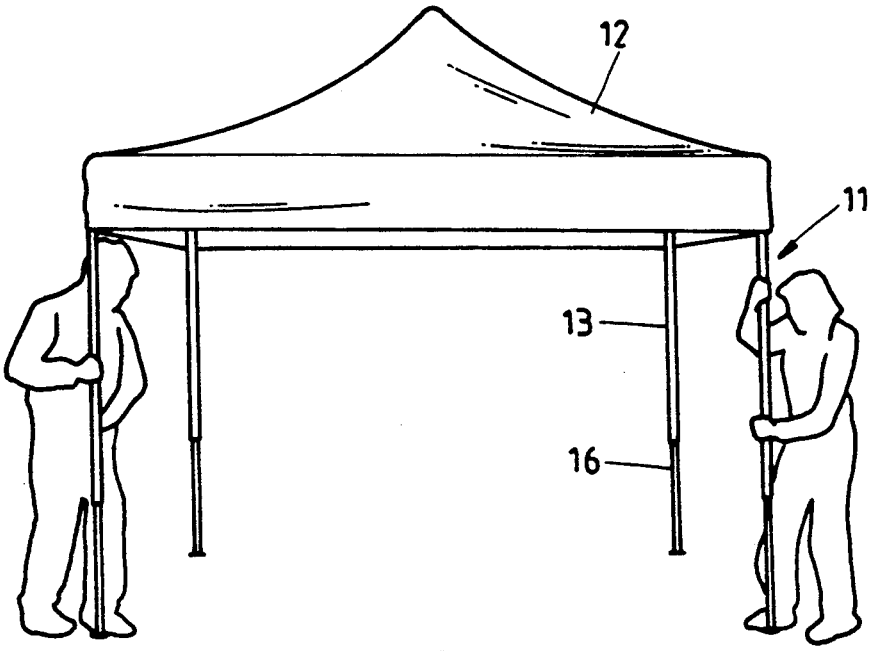
FIG. 1 illustrates the open position of the tent according to the present invention.
Figure 2:
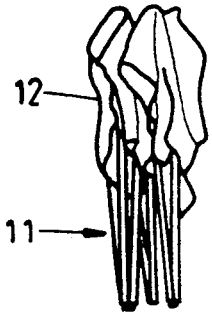
FIG. 2 illustrates the closed position of the tent according to the present invention.
Figure 3:
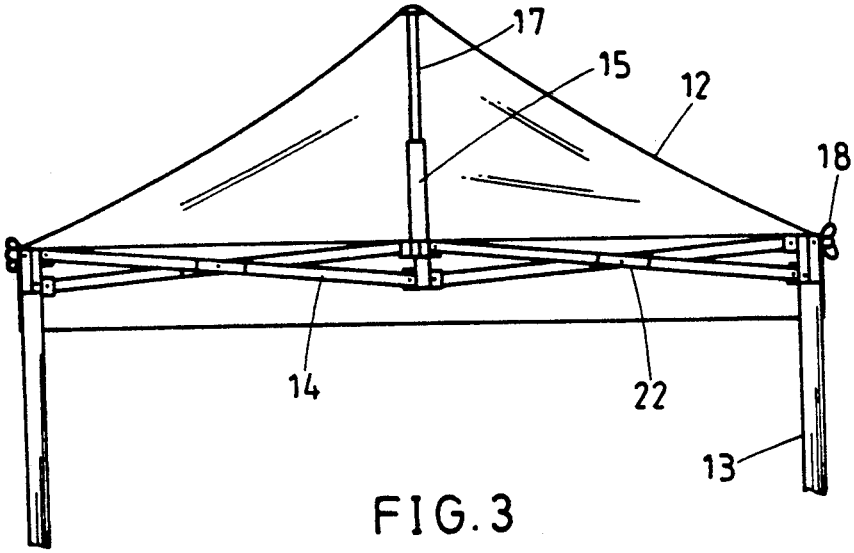
FIG. 3 is an illustration of the structure of the support assembly and the awning of the present invention.
Figure 4:
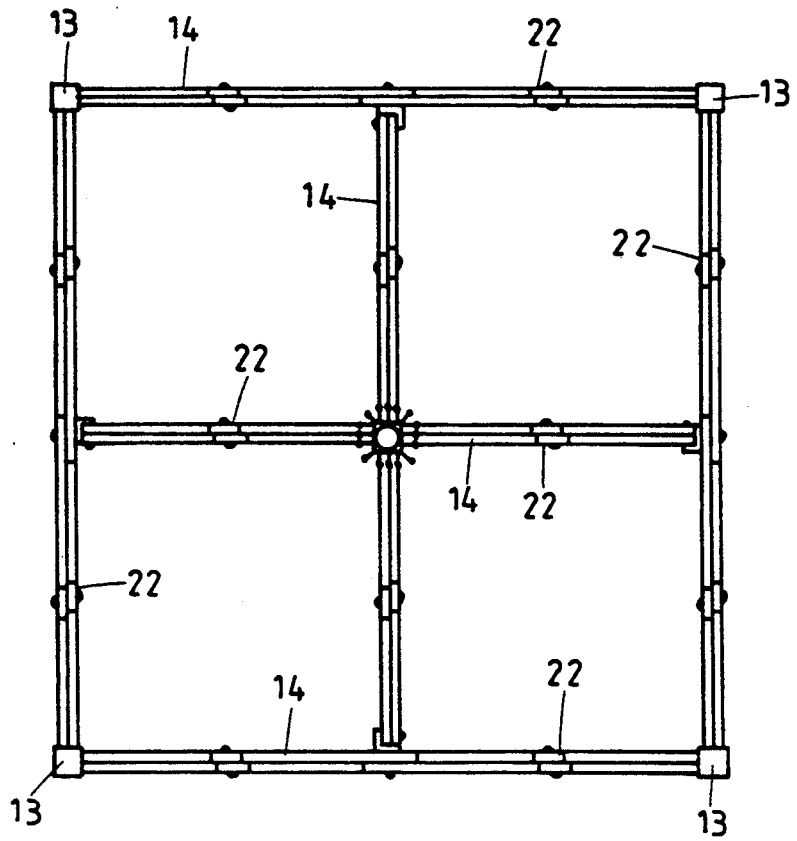
FIG. 4 is a top view of a supporting structure which looks like a window with a cross inside.

As illustrated in FIG. 1, the tent comprises a telescopic folding support assembly 11, and an awning 12 which covers the support assembly 11. The side view of the support assembly 11 is illustrated in FIG. 3. The assembly includes at least four main supporters 13, twelve supporting structures 14, which together form a top view which looks like a window with a cross in it (as in FIG. 4), and a topmost supporter 15 located in the center. Each main supporter 13 has a telescopic inner supporter 16, and the central topmost supporter 15 has an resilient inner supporter 17. Each supporting structure 14 is composed of two interlocking bars, and is equipped with a hinging screw to form a pivot point. In this manner, each main supporter 13 can extend and contract, and each supporting structure 14 can open and contract around the interlocking pivot point, so that the tent can be quickly opened and closed.

Between each main supporter 13 and the awning 12, as shown in FIG. 3, there is provided a protruding stud disposed at the top of each supporter 13. Studs are also provided at proper locations around the support assembly 11, where there is contact with the awning 12. Further, at four edges of the awning 12 there are provided locating holes corresponding to the studs. The studs fit into the locating holes, and secured thereto by tightening wing nuts 18 on the studs, so that the awning 12 can be properly secured upon the support assembly 11. By means of the studs and wing nuts, the tent can be assembled and taken apart very quickly.

Figure 5:
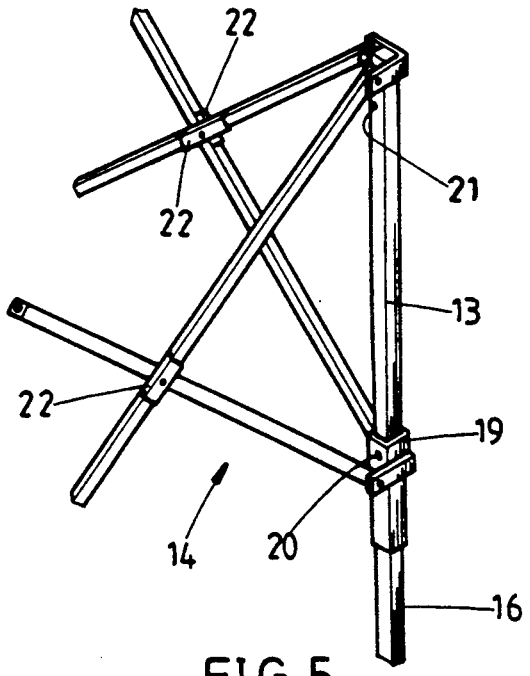
FIG. 5 is an illustration of a main supporter and connected supporting structures of the present invention.

As seen in FIG. 5, each main supporter 13 is provided with a slide 19 for joining the connecting supporting structures 14. Each slide 19 has a hole 20 for positioning the slide. An elastic pin 21 is provided at the top of each supporter 13. When the slide 19 moves to the top of the main supporter 13, with the supporting structures 14 fully opened, the elastic pin 21 will engage with the positioning hole 20 of slide 19, thereby stably locating the slide 19. This ensures that the support assembly of the tent is stable in its opened position.

Figure 7:
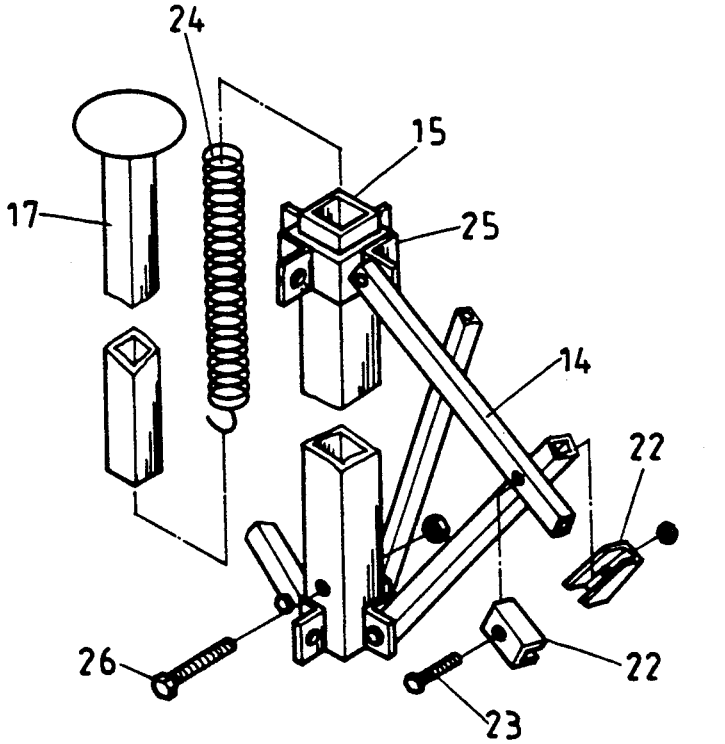

Additionally, as shown in FIGS. 5 and 7, each supporting structure 14 is composed of two interlocking bars and at the interlocking point, are provided with two U-shaped covers 22, one on each bar, through which the hinge bolt 23 passes to build a sturdy interlocking support. Therefore, the supporting strength at each interlocking point of each supporting structure is increased, and multiple interlocking movements of the support assembly will in no case diminish the supporting strength of the assembly as a whole.

Figure 6:
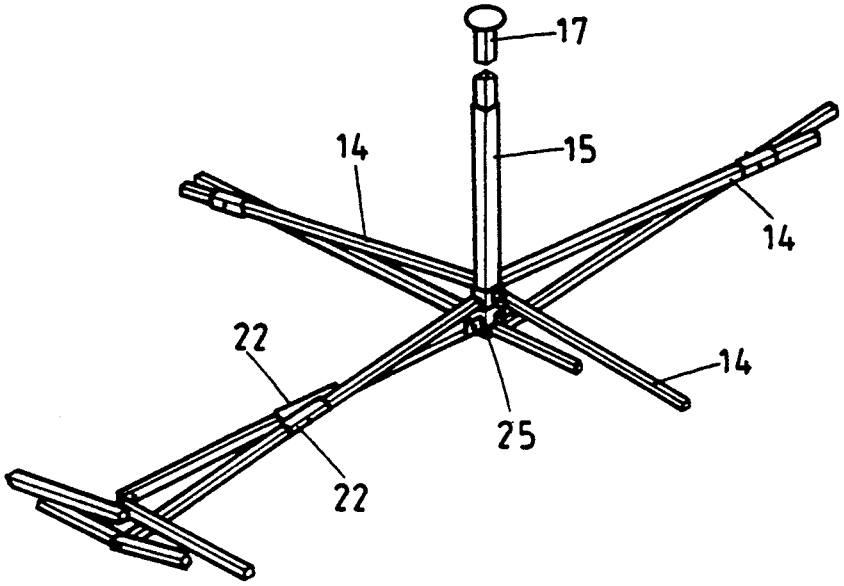
FIG. 6 is an illustration of the topmost supporter and connected supporting structures of the present invention; and, FIG. 7 is an illustration of a topmost supporter and an elastic inner supporter of the present invention.

As shown in FIGS. 5 and 6, the topmost supporter 15 is provided with a spring 24 and an inner supporter 17, which constitute a resilient inner supporting device. The topmost supporter 15 is located in the center of the whole support assembly, as shown in FIG. 6. The supporter 15 is connected to four pairs of supporting structures 14, in four directions by means of a slide 25. The spring 24 is fixed within the hollow interior of the topmost supporter 15, by means of a screw 26 which passes through the bottom of the topmost supporter 15. The inner supporter 17 is coupled to the top of the spring 24, so that the supporter 17 becomes resilient. When the awning is opened, it will be smooth, uniform and thus, aesthetic in appearance, as it is propped up by the elastic inner supporter 17 of the topmost supporter 15.

Therefore, as discussed above, the awning is secured with the wing nuts and studs to the support assembly, and the tent can be assembled or taken apart quickly, and its stability is also increased. Provision of the U-shaped covers and slides, increases the strength of the tent as well as its stability. The resilient inner supporter disposed in the topmost supporter increases the tension of the awning, keeping it smooth and good-looking. The folding tent is, therefore, more practical to use.

I claim:

1. A modified folding tent comprising:

an awning member; and, means for supporting said awning member over an area having a polygonal contour in a first position, said supporting means including:

a. at least four main support members vertically disposed at vertices of said polygonal area, each of said main support members having an inner support member telescopically engaged therewith, said inner support member being extendable from a lower end of said main support member to contact a base surface, each of said main support members having a stud extending from an upper end thereof for engagement with a respective through opening formed in said awning;

b. support connection means pivotally coupled to said main support members for stabilization thereof in said first position, said support connection means being displaceable for folding said awning support means to a second position, said support connection means including: (1) a plurality of pairs of interconnected bar members, each of said pairs of said plurality of pairs of bar members being pivotally interconnected at a point intermediate opposing ends thereof by a bolt, each of said pairs of interconnected bar members being pivotally coupled to a respective one of said main support members on one end thereof; (2) a plurality of U-shaped cover members, each of said plurality cover members being disposed on a respective bar member at said pivotal interconnection with said bolt passing therethrough; and (3) a plurality of first slide members, each of said plurality of first slide members being slidably coupled to a respective one of said main support members, each of said first slide members being pivotally coupled to a respective bar member from each of two angularly displaced pairs of interconnected bar members;

c. upper support means disposed centrally with respect to said polygonal area for resiliently supporting a central portion of said awning, said upper support means including: (1) a vertically disposed first upper support member, said first upper support member having a tubular contour; (2) a spring disposed within said first upper support member, said spring having a first end fixedly coupled to said upper tubular support member; and (3) a second upper support member telescopically engaged within said first upper support member and resiliently biased by said spring; and, d. a second slide member slidingly coupled to said first upper support member, said second slide member being pivotally coupled to a one end of each of a multiplicity of said plurality of pairs of interconnected bar members, each of said multiplicity of said plurality of pairs of interconnected bar members being pivotally coupled on an opposing end to a hinged connection between pairs of said interconnected bar members extending between two of said main support members.

* * * * *